US009409681B2

(12) United States Patent
Lonsway et al.

(10) Patent No.: US 9,409,681 B2
(45) **Date of Patent: *Aug. 9, 2016**

(54) CONTAINER, CLOSURE, AND PACKAGE

(71) Applicant: Owens-Brockway Glass Container Inc., Perrysburg, OH (US)

(72) Inventors: Michael J. Lonsway, Toledo, OH (US); Brian J. Chisholm, Sylvania, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/691,207

(22) Filed: Apr. 20, 2015

(65) Prior Publication Data

US 2015/0225135 A1 Aug. 13, 2015

Related U.S. Application Data

(63) Continuation of application No. 13/649,171, filed on Oct. 11, 2012, now Pat. No. 9,051,074.

(51) Int. Cl.

| | |
|---|---|
| ***B65D 41/00*** | (2006.01) |
| ***B65D 41/34*** | (2006.01) |
| ***B65D 1/02*** | (2006.01) |
| ***B65D 41/02*** | (2006.01) |
| ***B65D 51/16*** | (2006.01) |

(52) U.S. Cl.

CPC ..... *B65D 41/34* (2013.01); *B65D 1/0246* (2013.01); *B65D 41/02* (2013.01); *B65D 51/1688* (2013.01)

(58) Field of Classification Search

CPC ..... B65D 41/34

See application file for complete search history.

(56) References Cited

U.S. PATENT DOCUMENTS

| | | | |
|---|---|---|---|
| 2,398,553 | A | 4/1946 | Nyden |
| 2,789,719 | A | 4/1957 | Wheaton |
| 3,494,093 | A | 2/1970 | Downs et al. |
| 3,592,349 | A | 7/1971 | Baugh |
| 3,659,736 | A | 5/1972 | Riggs |
| 3,741,423 | A | 6/1973 | Acton et al. |

(Continued)

FOREIGN PATENT DOCUMENTS

| | | |
|---|---|---|
| EP | 0427688 | 5/1991 |
| EP | 0661218 | 7/1995 |
| FR | 2906228 | 3/2008 |

OTHER PUBLICATIONS

PCT International Search Report and Written Opinion, Int. Serial No. PCT/US2013/058939, Int. Filing Date: Sep. 10, 2013, Applicant: Owens-Brockway Glass Container Inc., Mail Date: Dec. 9, 2013.

*Primary Examiner* — Fenn Mathew
*Assistant Examiner* — Don M Anderson

(57) ABSTRACT

A closure inner shell includes an annular skirt extending axially from a base wall and having an external thread segment. The base wall may have a central passage and the skirt may have circumferentially spaced petals. A closure outer shell may include a vented plug seal extending axially through the central passage of the inner shell, and an annular outer skirt to engage the petals of the inner shell and having an internal thread segment for threaded engagement with the external thread segment of the inner shell. A container may include a container neck bead for engagement with the petals, an inner annular sealing surface for engagement with the plug seal, and an inner annular relief to cooperate with the vented plug seal to establish a vent path.

20 Claims, 5 Drawing Sheets

(56) References Cited

U.S. PATENT DOCUMENTS

| | | | | |
|---|---|---|---|---|
| 4,337,678 | A | 7/1982 | Mumford | |
| 4,487,325 | A | 12/1984 | Willingham | |
| 5,209,362 | A | 5/1993 | Lutzker | |
| 5,803,286 | A * | 9/1998 | Pfefferkorn ..... | B65D 1/1661 215/307 |
| 5,960,972 | A | 10/1999 | Larguia, Sr. | |
| 6,158,604 | A | 12/2000 | Larguia, Sr. et al. | |
| 6,672,469 | B2 | 1/2004 | Hessbrueggen et al. | |
| 6,679,395 | B1 | 1/2004 | Pfefferkorn et al. | |
| 2011/0000872 | A1 | 1/2011 | Aneas | |

* cited by examiner

CONTAINER, CLOSURE, AND PACKAGE

The present disclosure is directed to packages and, more particularly, containers, and closures for containers.

BACKGROUND AND SUMMARY OF THE DISCLOSURE

Container closures include crimpable closures, for example, securable to crown finishes of bottles. U.S. Pat. No. 3,494,093 illustrates an example crimp-type closure. Container closures also include threadable closures, for example, securable to threaded finishes of bottles. U.S. Pat. Nos. 2,789,719 and 4,337,678 illustrate examples of thread-type closures.

A general object of the present disclosure, in accordance with one aspect of the disclosure, is to provide a closure that is resealable to a container, is relatively comfortable to remove, and permits pressure in the container to be relieved before the closure is disengaged from the container, and to provide a container that has a crown finish that provides good "lip-feel" to one who consumes product directly from the container.

The present disclosure embodies a number of aspects that can be implemented separately from or in combination with each other.

A closure for a container having a neck with an external bead in accordance with one aspect of the disclosure includes an inner shell and an outer shell coupled to the inner shell. The inner shell includes an inner shell base wall having a central passage, and an annular skirt extending axially from the base wall radially outward of the central passage and having an outer surface and at least one external thread segment projecting from the outer surface. The outer shell includes an outer shell base wall, a plug seal extending axially from the base wall through the central passage of the inner shell base wall, and an annular outer skirt extending axially from the base wall radially outward of the plug seal and having at least one internal thread segment for threaded engagement with the at least one external thread segment of the inner shell.

In accordance with another aspect of the disclosure, there is provided a container that includes a body, a shoulder extending from the body, and a neck extending from the shoulder. The neck includes an axial outward end surface, an inner annular sealing surface axially spaced from the axial outward end surface, an inner annular relief axially between the annular sealing surface and the axial outward end surface and having a larger diameter than that of the inner annular sealing surface, an outer annular bead axially between the shoulder and the axial outward end surface and axially overlapping the inner annular relief, wherein the outer annular bead includes a radial outer surface, an axial outward surface, and an axial inward surface. The neck also includes an outer annular relief axially between the shoulder and the outer annular bead.

In accordance with a further aspect of the disclosure, there is provided a closure for a container having a mouth surrounded by an external bead. The closure includes an inner shell having an annular skirt with external thread segments and a plurality of angularly spaced grip petals, and an outer shell having an annular skirt with internal thread segments for threaded engagement with the external thread segments on the inner shell such that an edge of the skirt on the outer shell engages the grip petals and hooks the grip petals over the external bead upon tightening of the outer shell over the inner shell.

In accordance with an additional aspect of the disclosure, there is provided a closure inner shell that includes an inner shell base wall having a central passage, and an annular skirt extending axially from the base wall radially outward of the central passage and having an outer surface and at least one external thread segment projecting from the outer surface.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
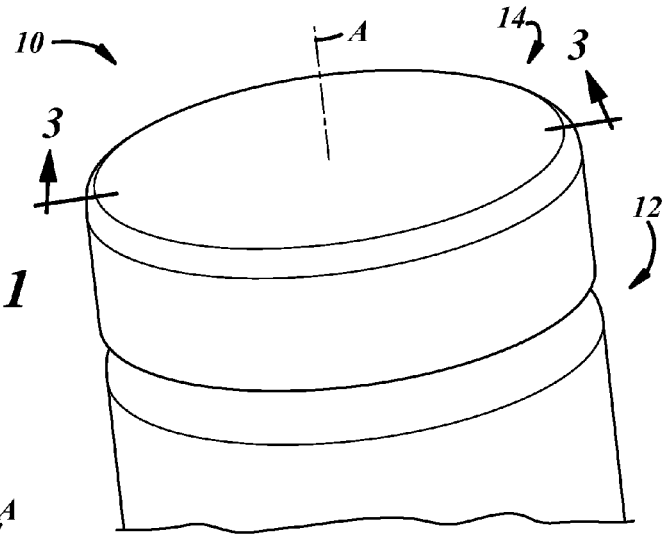
FIG. 1 is a fragmentary perspective view of a package in accordance with an illustrative embodiment of the present disclosure, illustrated with a closure according to an illustrative embodiment of the present disclosure that is applied to a container according to an illustrative embodiment of the present disclosure.

FIG. 1 illustrates a package 10 including a container 12, and a closure 14 coupled to the container 12. The package 10 includes a longitudinal axis A along which the container 12 generally extends, also along which the closure 14 may be applied to and removed from the container 12, and about which a portion of the closure 14 may be rotated. In one embodiment, the package 10 may include a beverage package, and may be used to contain pressurized liquid, for example, carbonated beverages, like beer, soda, etc. Accordingly, the package 10 may be a closed beer bottle, closed soda bottle, or the like. In other embodiments, the package 10 may include any other suitable type of closed container for any suitable purpose. As used herein, directional words such as top, bottom, upper, upward, downward, lower, radial, circumferential, lateral, longitudinal, transverse, vertical, horizontal, and the like are employed by way of description and not necessarily limitation.

Figure 2:
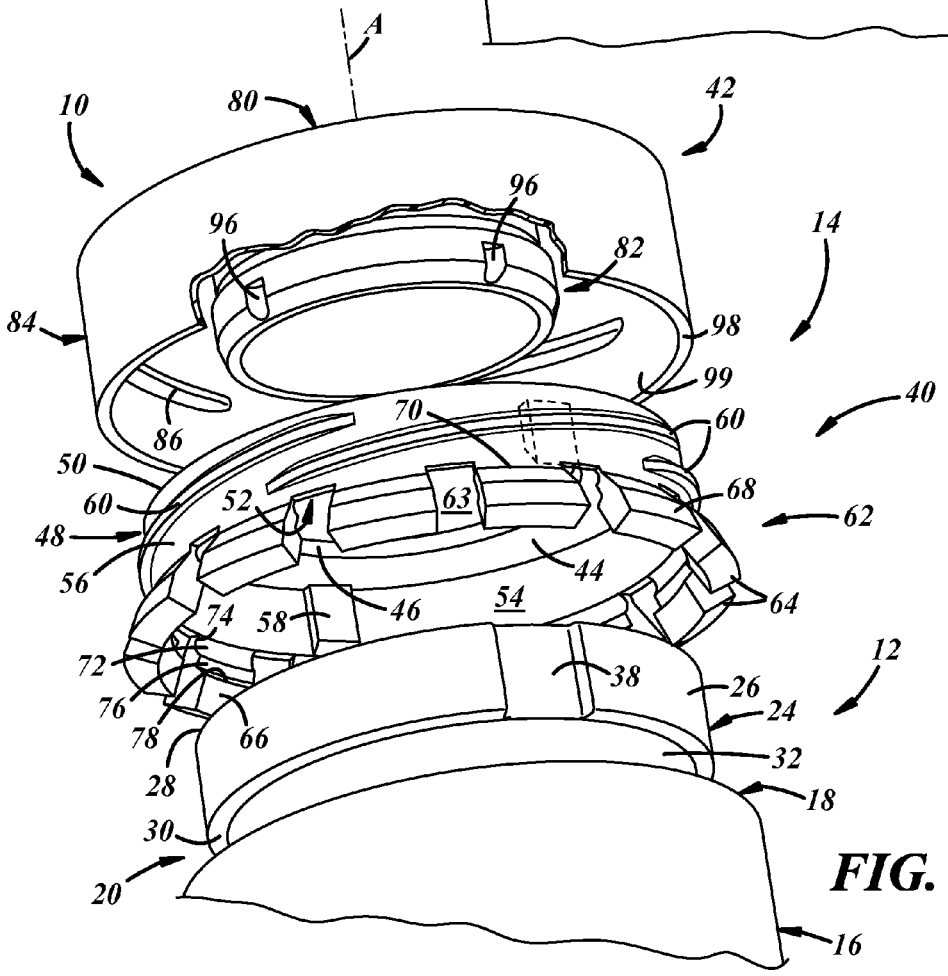
FIG. 2 is a fragmentary exploded perspective view of the package of FIG. 1, illustrating the closure exploded away from the container.

Referring now to FIGS. 2 and/or 3, the container 12 may be of one-piece integrally formed construction, preferably glass, plastic, or metal construction. (The term "integrally formed construction" does not exclude one-piece integrally molded layered glass constructions of the type disclosed for example in U.S. Pat. No. 4,740,401, or one-piece glass or metal bottles to which other structure is added after the bottle-forming operation.) The container 12 may be fabricated in press-and-blow or blow-and-blow glass container manufacturing operations, in a plastic injection and/or blow molding operation, in a metal drawing operation, or in any other suitable manner. The container 12 includes a base (not shown) on which the container 12 may be supported, a body 16 extending axially from the base, a shoulder 18 extending radially and axially from the body 16, and a neck 20 extending axially from the shoulder 18. As used herein, the term axial includes oriented generally along a longitudinal axis of the closure, container, or package and may include but is not limited to a direction that is strictly parallel to the axis. The neck 20 includes a lip or axial outward end surface 22 (FIG. 3), an outer annular bead 24 axially between the shoulder 18 and the axial outward end surface 22 and including a radial outer surface 26, an axial outward surface 28 that may be the same as or coplanar with the axial outward end surface 22 of the neck 20, an axial inward surface 30, and an outer annular reduced diameter portion or relief 32 axially between the shoulder 18 and the outer annular bead 24.

Figure 3:
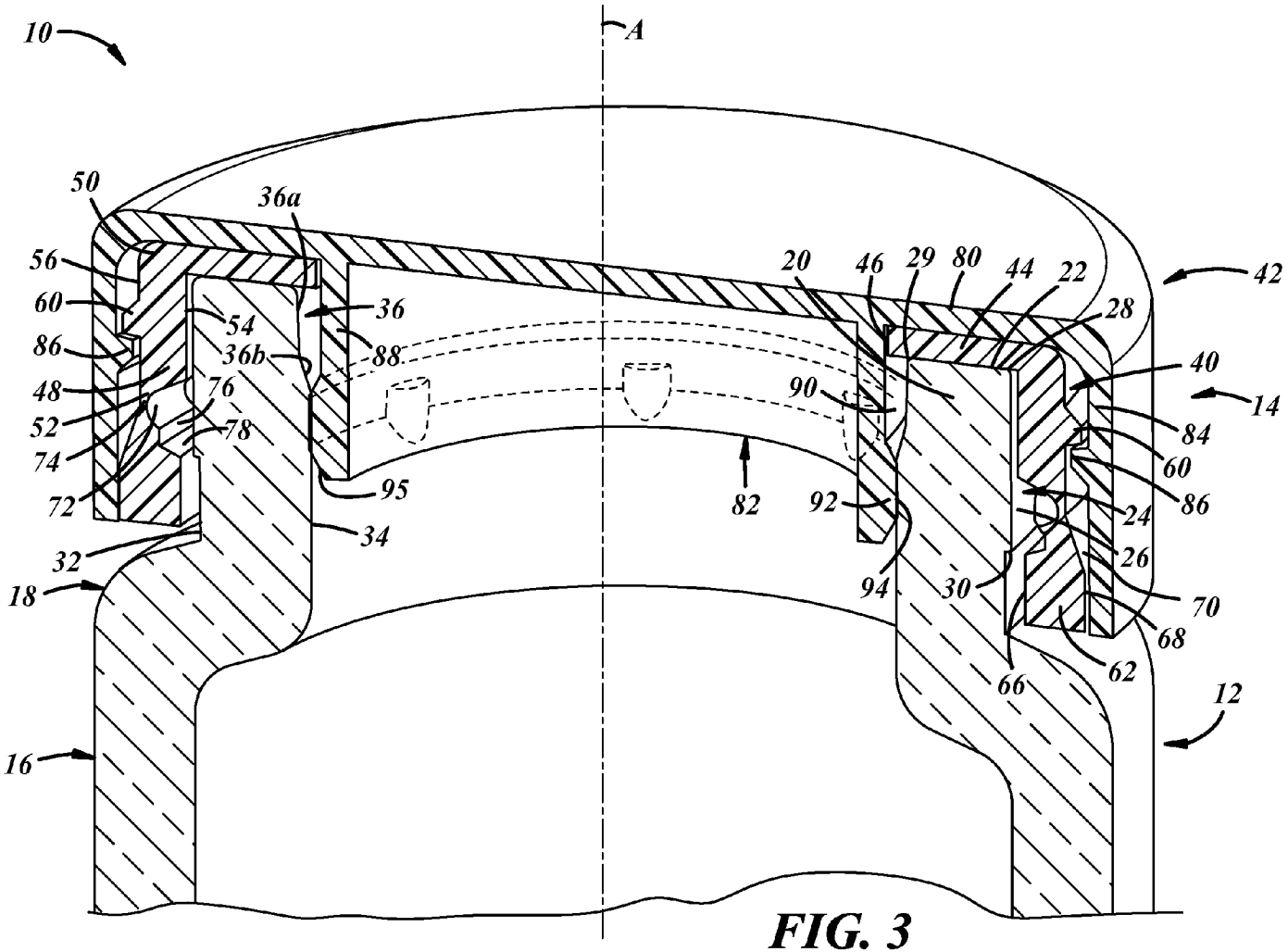
FIG. 3 is a fragmentary, perspective, cross-sectional view of the package illustrated in FIG. 2, taken along line 3-3 of FIG. 1.

With reference to FIG. 3, the neck 20 also may include an inner annular sealing surface 34 axially spaced from the axial outward end surface 22, and an inner annular relief 36 axially between the inner annular sealing surface 34 and the axial outward end surface 22 and having a larger diameter than that of the inner annular sealing surface 34. The annular relief 36 may axially overlap the outer annular bead 24 and may include an annular surface 36*a* and a tapered surface 36*b* between the annular surface 36*a* and the sealing surface 34.

Referring to FIGS. 2 and/or 3, the container 12 also may include one or more reliefs 38 in the radial outer surface 26 of the outer annular bead 24 and axially extending through the axial outward surface 28 of the outer annular bead 24. The relief(s) 38 also may axially extend through the axial inward surface 30 of the bead 24. The neck 20 also may include a mouth 29 (FIG. 3) between the axial outward surface 22 and the inner annular relief 36. The bead 24 may be relatively tall for good "lip feel". For example, the axial height or length of the bead 24 may be at least 0.080" in axial length. In another embodiment, the relief 38 and the lug 58 could be reversed, such that the lug 58 could be carried on the container neck and the relief 38 could be carried by the closure shell. The axial outward surface 22, the bead 24, and the mouth 29 may be referred to as the "finish" of the container 12. The finish also may include corresponding one or more interior portions of the neck 20, for example, the inner annular relief 36 and at least a portion of the sealing surface 34.

The closure 14 is a multi-piece closure and, in particular, may be a two-piece closure, for example, including only two shells. The closure 14 includes an inner shell 40, and an outer shell 42 coupled to the inner shell 40. The inner shell 40 secures directly to the container 12, and the outer shell 42 secures directly to the inner shell 40 and sealingly engages directly with the container 12. The inner and outer shells 40, 42 may be composed of any suitable plastic(s) and may be injection molded, compression molded, or produced in any other suitable manner.

The inner shell 40 includes an inner shell base wall 44 extending transversely with respect to the axis A having a central passage 46 with an inner diameter, and an annular skirt 48 extending axially from the base wall 44 radially outward of the central passage 46. As used herein, the term transverse may mean disposed at some angle with respect to a longitudinal axis of the closure, container, or package and along any direction intersecting the closure, container, or package, and may include but is not limited to a radial direction. The skirt 48 (FIG. 2) includes an upper or first axial end 50 at the base wall 44, a lower or second axial end 52, and inner and outer surfaces 54, 56 extending therebetween. The skirt 48 also includes one or more internal lugs 58 (FIG. 2) projecting from the inner surface 54 for registration in the corresponding reliefs 38 (FIG. 2) of the container 12 to radially restrain the inner shell 40 on the container 12. The skirt 48 further includes one or more external thread segments 60 projecting from the outer surface 56. As used herein, the term thread segment includes whole, partial, multiple, and/or an interrupted thread and/or thread segment.

The inner shell 40 also includes a plurality of petals 62 extending from the annular skirt 48, for example from the axially lower end 52, for gripping a corresponding portion of the container 12. The petals 62 are angularly or circumferentially spaced from one another, are circumferentially adjacent to one another with circumferential spaces 63 therebetween, and extend axially and radially outwardly in a free state of the inner shell 40. The petals 62 may include two or more petals, for example, four, six, eight, ten, twelve petals, or any other suitable quantity of petals. The petals 62 may include adjacent circumferential side surfaces 64 (FIG. 2), radially inner and outer surfaces 66, 68, and frustoconical surfaces 70 (FIG. 3) extending between the axially lower end 52 of the inner shell annular skirt 48 and the radially outer surfaces 68. The skirt 48 also may include radially inner incurvate surfaces 72 adjacent the axially lower end 52 of the skirt 48 and establishing a thinned wall 74 connecting the petals 62 to the lower end 52 of the skirt 48, and a radially inward facing shoulder 76 and an axially outward facing shoulder 78. The axially outward facing shoulder 78 may be tapered from the radially inward surface 66 upward to the radially inward facing shoulder 76. The shoulders 78 of the petals 62 engage the axial inward surface 30 of the outer annular bead 24 to retain the closure 14 on the container 12. The shell 40 may be molded so that the petals 62 extend axially and radially outwardly from the annular skirt 48 in a rest or free state, for example, as shown in FIG. 2. Accordingly, the petals 62 may be flexible radially inwardly and may have memory in that they resiliently return radially outwardly to their molded rest state.

The outer shell 42 includes an outer shell base wall 80, an annular inner skirt 82 extending axially from the base wall 80 through the central passage 46 of the inner shell 40 base wall 44 to retain the inner shell 40 to the outer shell 42, and an annular outer skirt 84 extending axially from the base wall 80 radially outward of the inner skirt 82 and having one or more internal thread segments 86 for threaded engagement with the external thread segment(s) 60 of the inner shell 40. The annular inner skirt 82 also may serve as an annular seal wall or plug seal for sliding contact or engagement with the annular sealing surface 34 of the container neck 20 when the closure 14 is applied to the container 12. The inner skirt 82 includes an annular wall 88 having an outer surface 90 with an outer diameter less than the inner diameter of the central passage 46. The inner skirt 82 also includes an annular enlargement 92 extending radially outwardly from the annular wall 88 and having an outer surface 94 with an outer diameter greater than the inner diameter of the central passage 46. The base wall 44 of the inner shell 40 is axially retained between the outer shell base wall 80 and the annular enlargement 92, which may be an annular seal.

The container 12 may be sealed by the closure 14 by engagement of the plug seal of the outer shell 42 with the inner annular sealing surface 34 of the container neck 20. The container 12 also may be sealed by the closure 14 by engagement of the base wall 44 of the inner shell 40 with the lip 22 of the container neck 20, and/or by engagement of the inner surface 58 of the annular skirt 48 of the inner shell 40 with the outer surface 26 of the annular bead 24 of the container neck 20.

Figure 4:
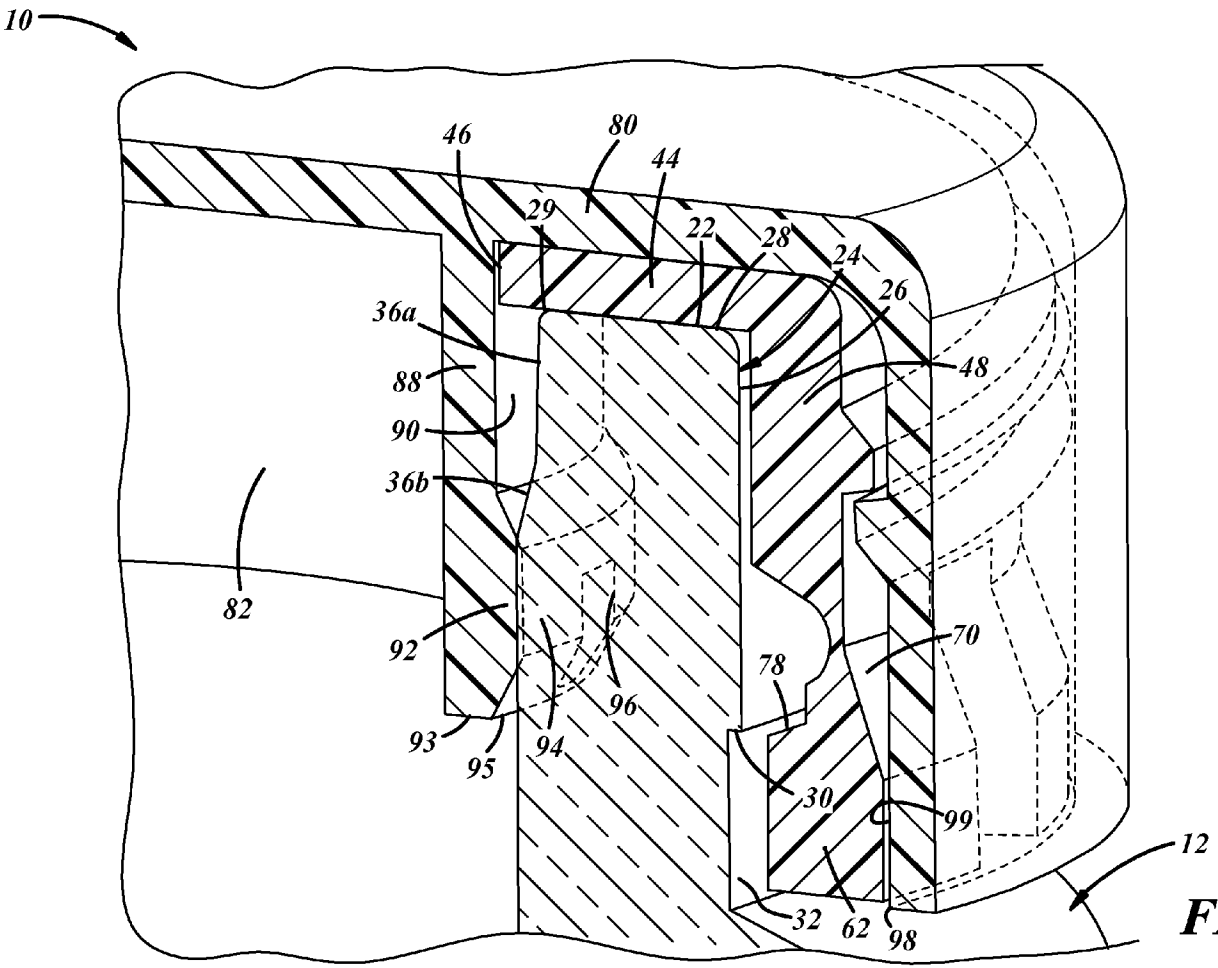
FIG. 4 is an enlarged view of the package illustrated in FIG. 3.

As best shown in FIG. 4, the inner skirt 82 further may include a frustoconical or tapered surface 95 that may extend radially inwardly from the outer surface 94 and that may intersect an axial end surface 93 of the skirt 82. The skirt 82 also may include one or more vent channels or reliefs 96, for example, in the outer surface 94, to cooperate with the inner annular relief 36 of the container neck 20 to establish a pressure relief or vent path when the closure 14 is being removed from the container 12. The reliefs 96 also may intersect the tapered surface 95 wherein axially lower portions of the reliefs 96 are axially open and axially upper portions of the reliefs 96 are closed by the outer surface 94 of the annular enlargement 92. The outer skirt 84 of the outer shell 42 includes an axially lower end or edge 98 and a radially inner surface 99 adjacent to the edge 98 to engage the petals 62 of the inner shell 40 and fold or hook the petals 62 over the container neck external bead 24 when the closure 14 is being applied to the container 12 such that the outer shell 42 is being tightened to the inner shell 40. The edge 98 may axially engage the tapers 70 to gradually fold the petals 62 into engagement with the container bead 24.

In use, the closure 14 may be assembled or preassembled and then applied to the container 12. For example, the annular inner skirt 82 of the outer shell 42 may be resilient and interference fit through the central passage 46 of the base wall 44 of the inner shell 40 so as to assemble the inner shell 40 to the outer shell 42. Then, the assembled closure 14 may be located over the container neck 20 wherein the annular inner skirt 82 of the outer shell 42 is inserted into the mouth 29 of the container neck 20, the petals 62 are located around the container neck 20, and the internal lugs 58 of the inner shell 40 are located in the corresponding reliefs 38 in the container neck 20. Thereafter, the outer shell 42 may be rotated relative to the inner shell 40 so that the internal threads 86 of the outer shell 42 threadingly engage the external threads 60 of the inner shell 40. Next, rotation of the outer shell 42 continues such that the annular outer skirt 84 of the outer shell 42 engages the petals 62 to fold or hook the petals 62 over the external bead 24 of the container neck 20 upon tightening of the outer shell 42 to the inner shell 40. Accordingly, the closure 14 is fastened and sealed to the container 12. More particularly, the outer shell 42 fastens to the inner shell 40 to cause fastening of the inner shell 40 to the container 12 while the inner skirt 82 of the outer shell 42 seals to the container 12.

Figure 5:
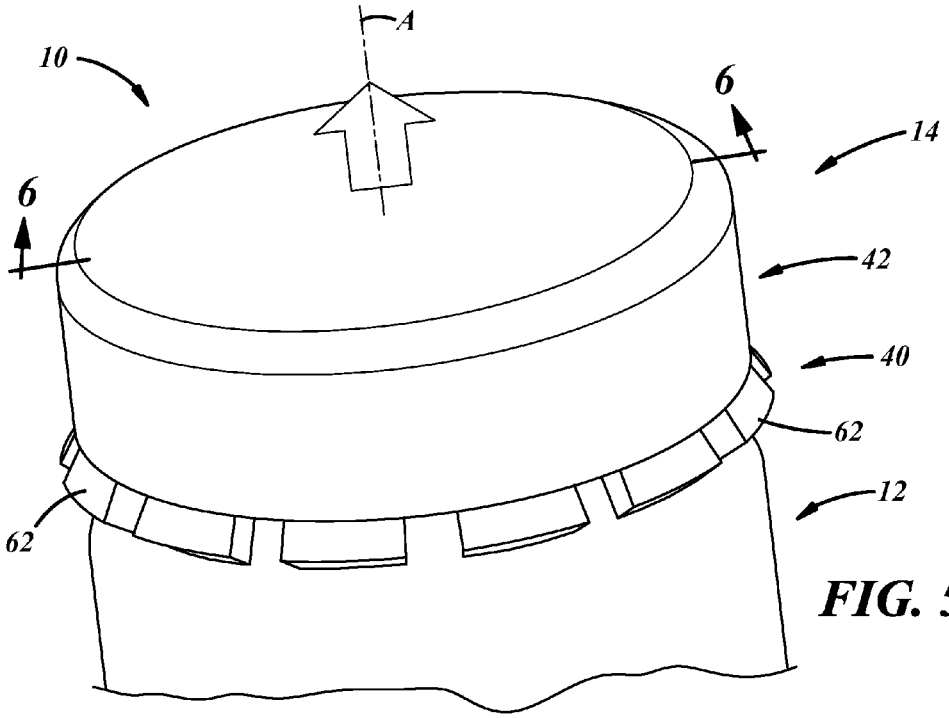
FIG. 5 is a fragmentary perspective view of the package of FIG. 1, illustrated with the closure being removed from or applied to the container.
Figure 6:
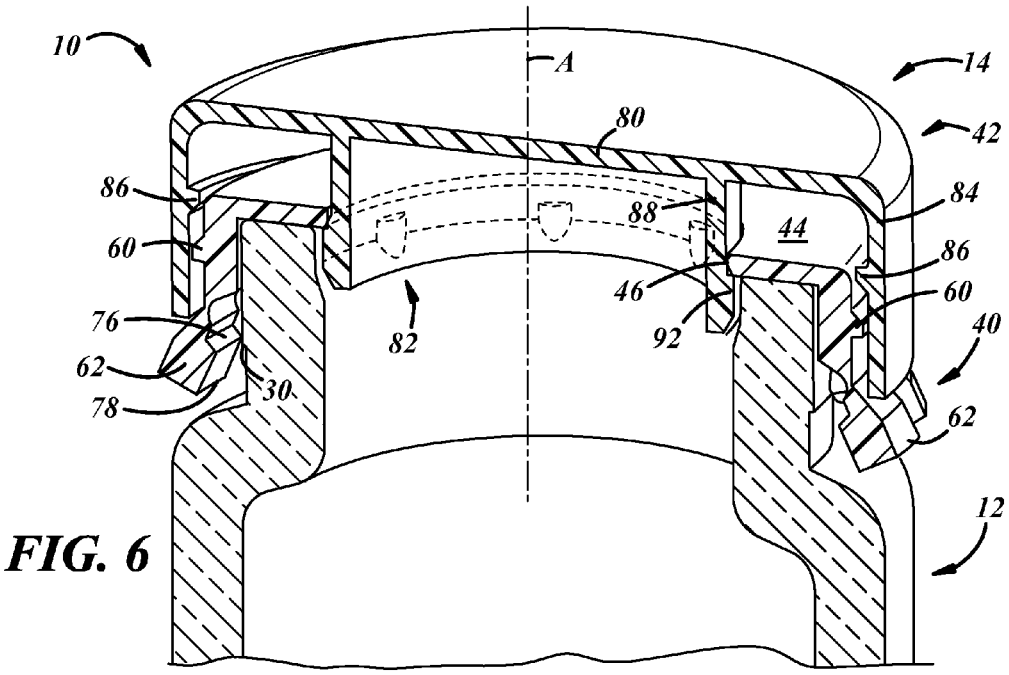
FIG. 6 is a fragmentary, perspective, cross-sectional view of the package illustrated in FIG. 5, taken along line 6-6 of FIG. 5.
Figure 7:
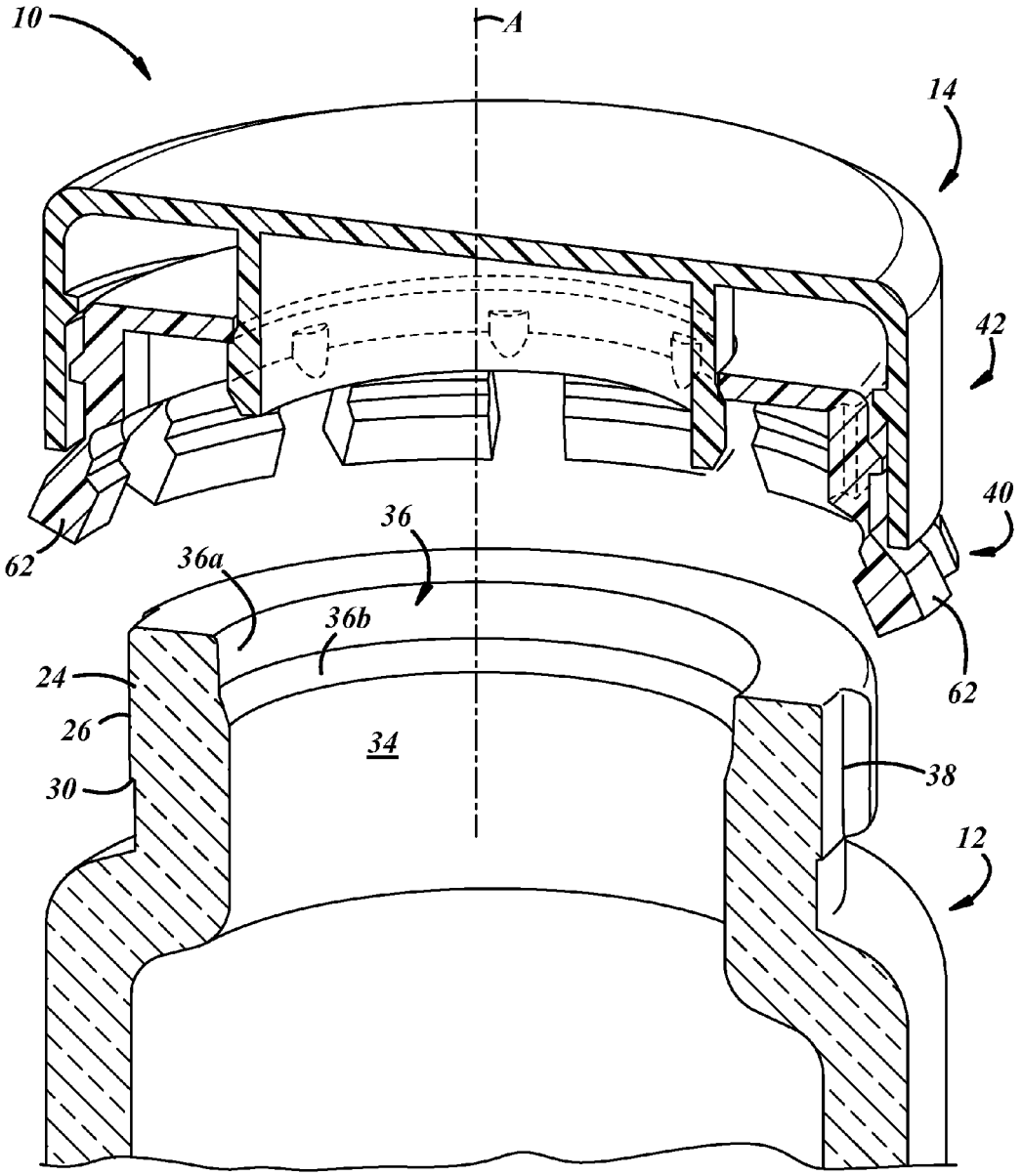
FIG. 7 is a fragmentary, exploded, perspective, cross-sectional view of the package of FIG. 1, illustrated with the closure removed from the container.

Also in use, the closure 14 may be removed from the container 12. For example the outer shell 42 may be rotated to threadingly disengage the internal thread segments 86 of the outer shell 42 from the external thread segments 60 of the inner shell 40. As the outer shell 42 is unscrewed from the inner shell 40, the inner skirt 82 slides axially along the sealing surface 34 of the container 12 and the relief(s) 96 in the inner skirt 82 axially overlap with the inner annular relief 36 of the container neck 20 at a desired spacing between the shells 40, 42 and thereby cooperate to establish a vent path to vent the container 12 to atmosphere before the petals 62 of the inner shell 40 completely disengage from the container neck bead 24. Accordingly, there may be some lost motion (axially) as the outer shell 42 moves axially relative to the container 12 but the inner shell 40 initially remains axially stationary with respect to the container 12. As shown in FIGS. 5 and 6, as the outer shell 42 continues to be unscrewed from the inner skirt 40, the outer skirt 84 of the outer shell 42 moves away from the petals 62 to allow the resilient petals 62 to resiliently unfold or return to their free state in which they extend axially and radially outwardly from the annular skirt 48 of the inner shell 40 and thereby release from the container 12. The inner shell lugs 58 cooperate with the reliefs 38 in the container bead 24 to prevent the inner skirt 40 from rotating relative to the container 12 as the outer shell 42 is unscrewed from the inner shell 40. As also shown in FIG. 6, the annular inner skirt 82 disengages from the inner sealing surface 34 of the container neck 20. Accordingly, the closure 14 can be pulled away from the container 12 as shown in FIG. 7, wherein a pulling force exerted on the outer shell 42 causes the inner shell 40 to be pulled away from the container 12 by way of the coupling between the outer shell 42 and the inner shell 40. Thereafter, the closure 14 may be reapplied and resealed to the container 12.

Accordingly, the package 10 includes a container neck without threads, but includes a closure that operates in a familiar screw-on, screw-off manner.

There thus has been disclosed a package, container, and closure, that fully satisfy all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A closure for a container having a neck with an external bead, which closure includes:

an inner shell including an inner shell base wall having a central passage, and an annular skirt extending axially from the base wall radially outward of the central passage and having an outer surface and at least one external thread segment projecting from the outer surface; and an outer shell coupled to the inner shell and including an outer shell base wall, a plug seal extending axially from the outer shell base wall through the central passage of the inner shell base wall, and an annular outer skirt extending axially from the outer shell base wall radially outward of the plug seal and having at least one internal thread segment for threaded engagement with the at least one external thread segment of the inner shell, wherein the plug seal is an annular seal and the base wall of the inner shell is axially retained between the annular seal and the outer shell base wall, wherein the outer shell also includes an annular wall and an annular enlargement extending radially outwardly from the annular wall and having an outer surface with an outer diameter greater than an inner diameter of the central passage.

2. The closure set forth in claim 1 wherein the annular enlargement outer surface includes a plurality of discrete, circumferentially spaced, vent reliefs therein.

3. The closure set forth in claim 2 wherein the vent reliefs have axially open lower portions and closed axially upper portions.

4. The closure set forth in claim 1 wherein the closure is a two-piece closure including only two shells, and wherein the inner shell also includes a plurality of petals extending from the annular skirt, and the outer skirt of the outer shell engages the petals of the inner shell and moves the petals over the container neck external bead when the closure is being applied to the container.

5. The closure set forth in claim 4 wherein the annular skirt of the inner shell includes an axially lower end from which the petals extend axially and radially outwardly in a free state of the inner shell.

6. A closure for a container having a mouth surrounded by an external bead, which closure includes:

an inner shell having an inner shell base wall with an opening therein having an inner diameter, and an annular skirt extending from the inner shell base wall with external thread segments and a plurality of angularly spaced grip petals, and an outer shell having an outer shell base wall, an annular inner skirt extending axially from the outer shell base wall and through the opening of the inner shell base wall and having an enlargement including an outer surface with an outer diameter greater than the inner diameter of the inner shell base wall opening to retain the inner shell to the outer shell, and an annular outer skirt with internal thread segments for threaded engagement with said external thread segments on said inner shell such that an edge of said skirt on said outer shell engages said grip petals and hooks said grip petals over said external bead upon tightening of said outer shell over said inner shell.

7. A package including a container and the closure set forth in claim 6 coupled thereto.

8. A closure inner shell that includes an inner shell base wall having a central passage, and an annular skirt extending axially from the base wall radially outward of the central passage and having an outer surface and at least one external thread segment projecting from the outer surface, an inner surface with at least one lug projecting radially inwardly therefrom, and a plurality of petals extending from an axially lower end of the annular skirt and having radially inwardly and axially outwardly facing shoulders.

9. A closure that includes the closure inner shell of claim 8, and a closure outer shell including an outer shell base wall, a plug seal extending axially from the base wall through the central passage of the inner shell base wall, and an annular outer skirt extending axially from the base wall radially outward of the plug seal and having at least one internal thread segment for threaded engagement with the at least one external thread segment of the inner shell.

10. The closure set forth in claim 9, wherein the outer skirt of the outer shell engages the petals of the inner shell and moves the petals over the container neck external bead when the closure is being applied to a container.

11. A closure that includes a closure outer shell including an outer shell base wall, a plug seal extending axially from the outer shell base wall and including an annular wall and an annular enlargement extending radially outwardly from the annular wall and having an outer surface with at least one vent relief therein, and an annular outer skirt extending axially from the outer shell base wall radially outward of the plug seal and having at least one internal thread segment, wherein the annular outer skirt includes an axially lower end and extends axially continuously from the outer shell base wall to the axially lower end and is axially longer than the plug seal, and an inner shell including an inner shell base wall having a central passage, and an annular skirt extending axially from the base wall radially outward of the central passage and having an outer surface and at least one external thread segment projecting from the outer surface, wherein the plug seal extends through the central passage of the inner shell base wall and wherein the at least one internal thread segment is in threaded engagement with the at least one external thread segment of the inner shell, wherein the outer shell annular enlargement has an outer diameter greater than an inner diameter of the central passage.

12. The shell set forth in claim 11 wherein the at least one vent relief has an axially open lower portion.

13. The closure set forth in claim 11 wherein the closure is a two-piece closure including only two shells, and wherein the inner shell also includes a plurality of petals extending from the annular skirt, and the outer skirt of the outer shell engages the petals of the inner shell and moves the petals over the container neck external bead when the closure is being applied to the container.

14. The closure set forth in claim 13 wherein the annular skirt of the inner shell includes an axially lower end from which the petals extend axially and radially outwardly in a free state of the inner shell.

15. The closure outer shell set forth in claim 11 wherein the plug seal includes an axial end surface and a tapered surface extending radially inwardly from the outer surface and intersecting the axial end surface, wherein the at least one vent relief intersects the tapered surface wherein an axially lower portion of the at least one vent relief is axially open and an axially upper portion of the at least one vent relief is closed by the outer surface.

16. The closure outer shell set forth in claim 11 wherein the at least one vent relief includes a plurality of vent reliefs in the outer surface of the annular enlargement.

17. The closure outer shell set forth in claim 16 wherein the vent reliefs are circumferentially spaced apart.

18. The closure set forth in claim 1 wherein the plug seal includes an axial end surface and a tapered surface extending radially inwardly from the outer surface and intersecting the axial end surface, wherein the at least one vent relief intersects the tapered surface such that an axially lower portion of the at least one vent relief is axially open and an axially upper portion of the at least one vent relief is closed by the outer surface.

19. The closure set forth in claim 6, wherein the base wall of the inner shell is axially retained between the annular enlargement and the outer shell base wall.

20. The closure inner shell set forth in claim 8, wherein the at least one lug includes diametrically opposed lugs.

* * * * *